US009469502B2

(12) United States Patent
Parkkinen et al.

(10) Patent No.: US 9,469,502 B2
(45) Date of Patent: Oct. 18, 2016

(54) DESTINATION CALL-GIVING DEVICE FOR GIVING DESTINATION CALLS IN AN ELEVATOR SYSTEM AND METHOD FOR OPERATING THE SAME

(71) Applicant: KONE Corporation, Helsinki (FI)

(72) Inventors: Jarmo Parkkinen, Espoo (FI); Jussi Hiltunen, Helsinki (FI); Kim Bergman, Helsinki (FI); Tommi Salonen, Helsinki (FI); Otto Miettinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 437 days.

(21) Appl. No.: 14/078,115

(22) Filed: Nov. 12, 2013

(65) Prior Publication Data

US 2014/0131142 A1 May 15, 2014

(30) Foreign Application Priority Data

Nov. 12, 2012 (FI) ..... 20126183

(51) Int. Cl.
*B66B 1/34* (2006.01)
*B66B 1/46* (2006.01)
*B66B 3/00* (2006.01)

(52) U.S. Cl.
CPC ..... *B66B 1/468* (2013.01); *B66B 3/006* (2013.01); *B66B 2201/4653* (2013.01)

(58) Field of Classification Search
CPC ..... B66B 1/468; B66B 3/006; B66B 2201/4653
USPC ..... 187/247, 380–389, 391–396
See application file for complete search history.

(56) References Cited

U.S. PATENT DOCUMENTS 4,836,336 A * 6/1989 Schroder ..... B66B 1/2458 187/384
5,192,836 A 3/1993 Schroder
6,062,346 A * 5/2000 Friedli ..... B66B 1/462 187/395
6,382,363 B1 * 5/2002 Friedli ..... B66B 1/468 187/384
6,978,863 B2 * 12/2005 Hikita ..... B66B 1/18 187/382

(Continued)

FOREIGN PATENT DOCUMENTS

CN 1956906 A 5/2007
CN 102300798 A 12/2011

(Continued)

*Primary Examiner* — Anthony Salata
(74) *Attorney, Agent, or Firm* — Birch, Stewart, Kolasch & Birch, LLP

(57) ABSTRACT

A method for giving a destination call to the control system of an elevator system is provided, in which method one or more predetermined departure floor-destination floor pairs are presented on the touch-sensitive display of a destination call-giving device having a touch-sensitive display, in which each pair identifies for the user one predetermined departure floor and one predetermined destination floor, and the departure floor-destination floor pair selected by the user is determined on the basis of a touch detected with the touch-sensitive display, and a destination call signal is sent to the control system of the elevator system, which signal identifies the departure floor and the destination floor of the departure floor-destination floor pair selected by the user. A call-giving device, an elevator system and a computer program product are provided to implement the aforementioned method.

20 Claims, 2 Drawing Sheets

(56) References Cited

U.S. PATENT DOCUMENTS

| | | | | |
|---|---|---|---|---|
| 7,021,429 | B2 * | 4/2006 | Hikita | B66B 1/462 187/391 |
| 7,445,090 | B2 * | 11/2008 | Bodmer | B66B 1/463 187/391 |
| 8,003,907 | B2 * | 8/2011 | Hoshino | B66B 3/00 200/308 |
| 8,069,957 | B2 * | 12/2011 | Miyajima | B66B 1/468 187/382 |
| 8,136,636 | B2 * | 3/2012 | Bahjat | B66B 1/463 187/391 |
| 8,210,321 | B2 * | 7/2012 | Finschi | B66B 1/14 187/388 |
| 8,230,979 | B2 * | 7/2012 | Finschi | B66B 1/14 187/387 |
| 8,662,256 | B2 * | 3/2014 | Asano | B66B 1/2458 187/380 |
| 2012/0138388 | A1 | 6/2012 | Finschi et al. | |
| 2015/0246790 | A1 * | 9/2015 | Hiltunen | B66B 1/461 187/382 |

FOREIGN PATENT DOCUMENTS

| | | | |
|---|---|---|---|
| EP | 1 864 933 | A1 | 12/2007 |
| EP | 2 149 532 | A1 | 2/2010 |
| JP | 2003-212446 | A | 7/2003 |

* cited by examiner

1: Destination call-giving device
2: Processing unit
3: Touch-sensitive display
15: Data transfer channel

DESTINATION CALL-GIVING DEVICE FOR GIVING DESTINATION CALLS IN AN ELEVATOR SYSTEM AND METHOD FOR OPERATING THE SAME

FIELD OF THE INVENTION

The invention relates to elevator systems applicable to the transportation of people and/or of freight. More particularly the invention relates to the giving of destination calls in an elevator system.

BACKGROUND OF THE INVENTION

Passengers using elevators can generally give calls to elevators either in an elevator car and/or in an elevator lobby. Elevator lobbies are typically provided with up/down pushbuttons, by means of which a passenger can order an elevator to the call floor and simultaneously indicate his/her travel direction. After the elevator has arrived at the call-giving floor, the passenger moves into the elevator car and indicates his/her destination floor with the pushbuttons of the car panel in the elevator car. To a constantly increasing extent so-called destination call systems are used in high-rise buildings, in which systems a passenger indicates his/her destination floor already before going into the elevator car. For giving destination calls a passenger uses a destination call-giving device. A destination call-giving device is generally provided with a so-called decimal numeric keypad and a display means. If a passenger is going e.g. to floor 24, he/she keys into the decimal numeric keypad first the number 2 and then the number 4. The destination operating panel sends the information about the call-giving floor and about the aforementioned floor 24 to the control system of the elevator system. When the call-giving device is portable, or when the system does not otherwise know from which floor a call comes, a destination call must include information about the departure floor. After it has received a destination call the control system of the elevator system allocates the optimal elevator for the use of the passenger and transmits information about this to the call-giving device, on which appears e.g. the text "Elevator B".

In this way the elevator system identifies to the user in response to a destination call the elevator allocated to him/her. One problem is that selection of the floors by entering a number at a time requires a lot of keying activity, and the selection is for this reason slow. More particularly, if a passenger should select both the departure floor and the destination floor, a selection arranged with conventional methods would be extremely slow. Another problem is that when entering floors with a number of key sequences, incorrect keying easily occurs. For rectifying incorrect keying, the occurrence of an error must be indicated and the keying in must be performed again. This slows down use of the system even more. Yet another problem is that solutions according to prior art do not enable rapid floor selection in a building having selectable floors with an identifier string that comprises three-digit floor numbers. Yet another problem is that for a selection in solutions according to prior art a large number of icons, pushbuttons, et cetera, must be presented to a user. Thus, the solutions are not well suited to call-giving devices in which the size of the display is small.

SUMMARY OF THE INVENTION

The aim of the present invention is to solve the aforementioned problems of prior-art solutions as well as the problems disclosed in the description of the invention hereinafter. More particularly, the aim is to improve the call-giving of an elevator system. Among other things, some embodiments are presented where the giving of a destination call, and more particularly the selection of a departure floor and destination floor belonging to it, is fast and simple to perform. Among other things, some embodiments are presented where the giving of a destination call can be performed quickly and simply with a portable destination call-giving device. Among other things, some embodiments are presented where the giving of a destination call can be performed with a destination call-giving device provided with a small-sized touch-sensitive display.

According to a first aspect of the present invention, a method according to the invention is presented for giving a destination call to the control system of an elevator system. One or more departure floor-destination floor pairs are presented on the touch-sensitive display of a call-giving device having a touch-sensitive display, in which each pair identifies for the user one predetermined departure floor and one predetermined destination floor. The departure floor-destination floor pair selected by the user is determined on the basis of a touch detected with the touch-sensitive display, and a destination call signal is sent to the control system of the elevator system, which identifies the departure floor and the destination floor that are according to the selection of the user. A user can in this case bring about with a low number of touches the sending of a destination call, because the call-giving device receives sufficient information when the user selects one pair. Selection of both the departure floor and the destination floor can thus be performed with one selection, and even with just one touch. Each aforementioned pair can form a shortcut for selecting a departure floor and a destination floor with a single selection. Preferably in the method by an action of the destination call-giving device a destination call is sent to the control system of the elevator system automatically after determining a selection.

According to a second aspect of the present invention, the information of the aforementioned one or more departure floor-destination floor pairs is recorded in the memory of a destination call-giving device. The memory is preferably long-lasting in such a way that the information in question does not disappear in connection with extinguishing the destination call-giving device. One advantage is that once a pair has been formed, it does not need to be formed again. In this way good utilizability of the pairs for a speed-select is achieved.

According to a third aspect of the present invention, a plurality of the aforementioned types of departure floor-destination floor pairs are displayed, and the departure floor-destination floor pair selected by the user from the aforementioned plurality of departure floor-destination floor pairs is determined on the basis of a touch detected with the touch-sensitive display.

According to a fourth aspect of the present invention, a confirmation about the sending of a destination call signal is presented to the user on the touch-sensitive display. In this way a user knows that the call has been sent and can start moving towards the elevators.

According to a fifth aspect of the present invention, a response signal to the destination call signal sent to it is received from the control system of the elevator system, the response signal contains information identifying the elevator car, and the information identifying the elevator car is presented to the user on the touch-sensitive display. In this way a user receives information about the elevator car that he/she must step into. This is particularly advantageous when the elevator system includes a plurality of elevators, so that the user does not step into the wrong elevator car.

According to a sixth aspect of the present invention, a departure floor and a destination floor are identified from the aforementioned one or more departure floor-destination floor pairs, and the floors correspond to the departure floor and the destination floor identified by the destination call signal sent earlier with the call-giving device to the control system of the elevator system. In this case it is quick for a user to repeat a destination call given earlier. The pair in question in this case forms a speed-select for repeating a destination call given earlier. The information about each such pair is preferably recorded in a memory, which is long-lasting in such a way that the information in question does not disappear in connection with extinguishing the destination call-giving device.

According to a seventh aspect of the present invention, a new departure floor-destination floor pair is formed, in which case the departure floor and the destination floor that are identified by the departure floor-destination floor pair to be formed are set to correspond to the departure floor and the destination floor identified by a destination call signal sent earlier with the call-giving device to the control system of the elevator system. In this way a new pair can be formed. Preferably the destination call-giving device makes the formation automatically. In this way the list of pairs can be updated, and are based on recent calls that can be selected by a user. The new departure floor-destination floor pair to be formed is preferably recorded in the memory of the destination call-giving device. The memory is most preferably long-lasting memory in such a way that the information about the pair to be formed does not disappear in connection with extinguishing the destination call-giving device.

According to an eighth aspect of the present invention, historical data is collected about the departure floors and destination floors identified by destination call signals sent to the control system of the elevator system with a call-giving device. In this way, for example, information can be achieved for forming pairs based on recent calls.

According to a ninth aspect of the present invention, a departure floor input earlier by the user and a destination floor input earlier by the user are identified for the user from the aforementioned one or more departure floor-destination floor pairs. Each such pair in this case forms a speed-select for sending the type of destination call that identifies a departure floor-destination floor entered earlier by the user. The information about each such pair is preferably recorded in a memory, which is long-lasting in such a way that the information does not disappear in connection with extinguishing the destination call-giving device.

According to a tenth aspect of the present invention, a new departure floor-destination floor pair is formed, and the user inputs separately a departure floor and a destination floor for identifying the new departure floor-destination floor pair. The new departure floor-destination floor pair to be formed is preferably recorded in the memory of the destination call-giving device. The memory is most preferably long-lasting in such a way that the information of the new pair does not disappear in connection with extinguishing the destination call-giving device.

According to an eleventh aspect of the present invention, a touch-sensitive area, preferably a touch-sensitive pushbutton on the touch-sensitive display, is associated with each aforementioned departure floor-destination floor pair to be presented on the touch-sensitive display, and the departure floor-destination floor pair selected by the user is determined on the basis of the point of the touch of the user. Preferably in the method a departure floor-destination floor pair for selection by the user is determined in response to a touch detected at the point of the touch-sensitive area associated with the pair in question. In this way the aforementioned pair forms a quick-to-use speed-select for sending a destination call. Preferably the aforementioned touch is a single point-form touch.

According to a twelfth aspect of the present invention, each pair is presented on the touch-sensitive display by presenting the departure floor and the destination floor identified by the pair in the proximity of each other, preferably beside each other.

According to a thirteenth aspect of the present invention, a computer program product is provided. The computer program includes program commands, which bring a computer provided with a touch-sensitive display and an output, e.g. a portable computer such as a mobile phone or tablet, to perform any method whatsoever according to what is described above. When the program commands are run in the aforementioned computer, which is arranged to communicate via an output with the control system of the elevator system. In this way the advantages mentioned earlier in connection with the method can be achieved.

According to a fourteenth aspect of the present invention, a destination call-giving device for giving destination calls in an elevator system is provided. The destination call-giving device includes means available to a user for selecting a departure floor and a destination floor, and an output for communicating the selected departure floor and destination floor to the control system of the elevator system. The means for selecting a departure floor includes a touch-sensitive display forming a user interface for presenting to the user information related to the selection of a departure floor and a destination floor and for receiving the input of the user. The means for selecting a departure floor and a destination floor from a plurality of floors are arranged to present one or more departure floor-destination floor pairs on the touch-sensitive display, in which each pair identifies for the user one predetermined departure floor and one predetermined destination floor, and to determine the departure floor-destination floor pair selected by the user on the basis of a touch detected with the touch-sensitive display, and to send a destination call signal to the control system of the elevator system, which signal contains information, which identifies the departure floor and the destination floor that are according to the selection of the user. In this way the advantages mentioned earlier, inter alia, in connection with the method can be achieved.

According to a fifteenth aspect of the present invention, the information of the aforementioned one or more departure floor-destination floor pairs is recorded in the memory of a destination call-giving device. The memory is preferably long-lasting in such a way that the information in question does not disappear in connection with extinguishing the destination call-giving device. One advantage is that once a pair has been formed, it does not need to be formed again. In this way good utilizability of the pairs for a speed-select is achieved.

According to a sixteenth aspect of the present invention, the means for selecting a departure floor and a destination floor from a plurality of floors are arranged to present a plurality of such aforementioned departure floor-destination floor pairs, and to determine the departure floor-destination floor pair selected by the user from the aforementioned plurality of departure floor-destination floor pairs on the basis of a touch detected with the touch-sensitive display.

According to a seventeenth aspect of the present invention, the means for selecting a departure floor and a destination floor from a plurality of floors include a processing unit, which is arranged to send to the control system of the elevator system a destination call automatically after determining the selection.

According to an eighteenth aspect of the present invention, the destination call-giving device, more particularly the processing unit of it, is arranged to present on the touch-sensitive display to the user a confirmation about the sending of a call.

According to a nineteenth aspect of the present invention, the destination call-giving device, more particularly the processing unit of it, is arranged to receive a response signal to the destination call signal sent to it from the control system of the elevator system, which response signal contains information identifying an elevator car, and the information identifying the elevator car is presented to the user on the touch-sensitive display.

According to a twentieth aspect of the present invention, at least one of the aforementioned pairs identifies a departure floor and destination floor entered beforehand by a user.

According to a twenty-first aspect of the present invention, at least one of the aforementioned pairs identifies the departure floor and destination floor predetermined by the destination call-giving device.

According to a twenty-second aspect of the present invention, a departure floor and a destination floor are arranged to be identified from the aforementioned one or more departure floor-destination floor pairs, which departure floor and destination floor correspond to the departure floor and the destination floor identified by a destination call signal sent earlier with the call-giving device to the control system of the elevator system. The information of each such pair is preferably recorded in a memory, which is long-lasting in such a way that the information of the pair does not disappear in connection with extinguishing the destination call-giving device.

According to a twenty-third aspect of the present invention, the means for selecting a departure floor and a destination floor are arranged to form a new departure floor-destination floor pair by setting the departure floor and the destination floor that are identified by the departure floor-destination floor pair to be formed to correspond to the departure floor and the destination floor identified by a destination call signal sent earlier with the call-giving device to the control system of the elevator system. The information of the new pair is preferably arranged to be recorded in a memory, which is long-lasting in such a way that the information of the new pair does not disappear in connection with extinguishing the destination call-giving device.

According to a twenty-fourth aspect of the present invention, the means for selecting a departure floor and a destination floor are arranged to collect historical data about the departure floors and destination floors identified by destination call signals sent to the control system of the elevator system with a call-giving device.

According to a twenty-fifth aspect of the present invention, a departure floor input earlier by the user and a destination floor input earlier by the user are identified for the user from the aforementioned one or more departure floor-destination floor pairs.

According to a twenty-sixth aspect of the present invention, the means for selecting a departure floor and a destination floor are arranged to form a new departure floor-destination floor pair by receiving a departure floor and a destination floor input by a user for identifying the new departure floor-destination floor pair. The means for selecting a departure floor and a destination floor are preferably arranged to record the information of the pair in question in a memory, which is long-lasting in such a way that the information of the new pair does not disappear in connection with extinguishing the destination call-giving device.

According to a twenty-seventh aspect of the present invention, a touch-sensitive area on the touch-sensitive display, preferably a touch-sensitive pushbutton presented on the touch-sensitive display, is associated with each aforementioned departure floor-destination floor pair to be presented on the touch-sensitive display, and the means for selecting a departure floor and a destination floor are arranged to determine the departure floor-destination floor pair selected by the user on the basis of the point of the touch of the user.

According to a twenty-eighth aspect of the present invention, the means for selecting a departure floor and a destination floor are arranged to determine a departure floor-destination floor pair for selection by the user in response to a touch detected at the point of the touch-sensitive area associated with the pair in question.

According to a twenty-ninth aspect of the present invention, an elevator system is provided. The elevator system includes one or more elevator cars, and a control system, which is arranged to control the aforementioned one or more elevator cars on the basis of the destination calls of a destination call-giving device communicating with the aforementioned control system, which destination call-giving device is one of the types described earlier. The call-giving of an elevator system is in this case faster and simpler than before. In this way advantages are achieved corresponding to those with the method and with the destination call-giving device mentioned earlier.

According to a thirtieth aspect of the present invention, the control system is arranged to allocate an elevator car in response to a destination call received from the aforementioned destination call-giving device, and to communicate to the destination call-giving device the allocated elevator car, and the destination call-giving device is arranged to identify for the user the allocated elevator car on the touch-sensitive display.

According to a thirty-first aspect of the present invention, each elevator of the elevator system is most preferably an elevator applicable to the transporting of people and/or of freight, and is installed in a building, to travel in a vertical, or at least essentially vertical, direction, preferably on the basis of calls made at least from a floor landing and possibly also from a car. The elevator car preferably has an interior space, which is suited to receive a passenger or a number of passengers. The elevator preferably includes at least two, possibly more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein.

DETAILED DESCRIPTION OF THE INVENTION

Figure 1:
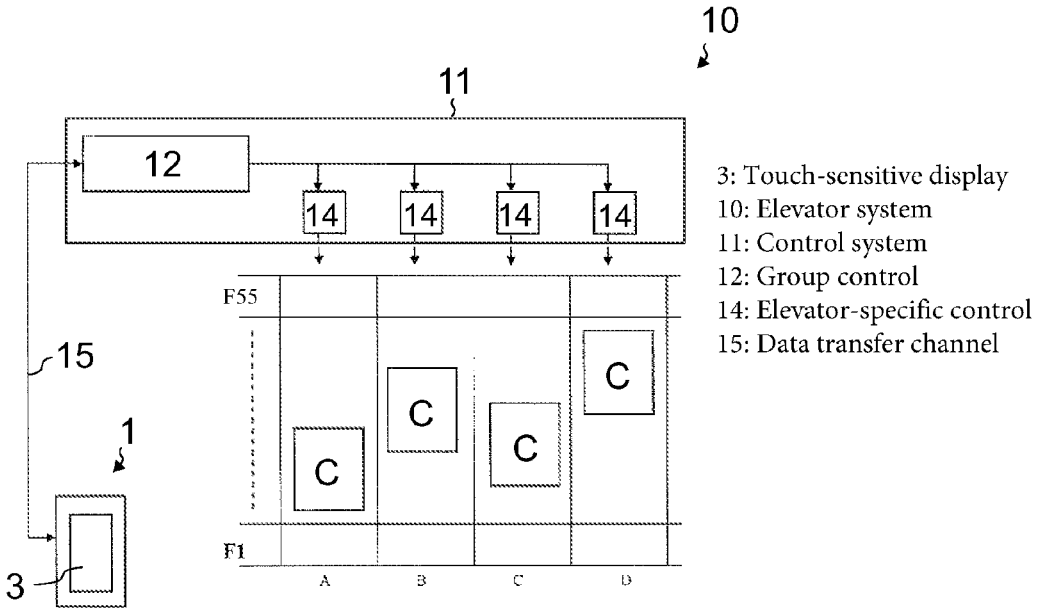
FIG. 1 presents an elevator system according to the invention.

FIG. 1 presents an elevator system 10 according to the invention, which comprises a plurality of elevators A, B, C and D and also a control system 11. The control system 11 is arranged to control the elevators A-D, more particularly the elevator cars C of them, on the basis of the destination calls of a destination call-giving device 1 communicating with the control system 11. For controlling the elevators, the control system comprises a group control 12 of the elevator system and also elevator-specific controls 14. The elevators serve in this case the floors 1-55 (F1-F55) in the building. A destination call device 1 is connected via a data transfer channel 15 to the control system 11. The destination call device 1 is preferably a portable device, e.g. a mobile phone or tablet. The data transfer channel 15 can be any data transfer channel whatsoever suited to the purpose. When the destination call-giving device 1 is portable, the data transfer channel is preferably wireless. The elevator system 10 functions in such a way that a destination floor is selected with a destination call-giving device 1 and a destination call is sent to the to the control system 11, which destination call contains information about the destination floor selected by the user of the destination call-giving device 1. The control system 11 is arranged to allocate according to a certain predetermined logic some elevator car C of the elevator system 10 in response to a destination call received from the aforementioned destination call-giving device 1, and to communicate to the destination call-giving device 1,1' the allocated elevator car, e.g. the identifier (A, B, C or D) of the elevator car allocated. The destination call-giving device 1 identifies on the touch-sensitive display 1 the identifier of the elevator car C allocated to the user. After the allocation the control system 11 controls the allocated elevator car to the floor on which the aforementioned destination call was given for taking the user (i.e. passenger) on board, and transports the user to the destination floor. The aforementioned logic selects the most advantageous elevator car C preferably on the basis of predetermined criteria, which elevator car can transport the user of the destination call-giving device (i.e. passenger) to the destination floor. The destination call-giving device 1 comprises means 2,3 available to a user for selecting a departure floor and a destination floor from a plurality of floors, and an output $O_1$ for communicating the selected departure floor and destination floor to the control system 11 of the elevator system 10. The aforementioned means 2,3 for selecting a departure floor comprise a touch-sensitive display 3 forming a user interface for presenting to the user information related to the selection of a departure floor and a destination floor and for receiving the input of the user. The aforementioned means 2,3 are arranged to present one or more predetermined departure floor-destination floor pairs on the touch-sensitive display 3, in which each pair identifies for the user one predetermined departure floor and one predetermined destination floor, and to determine the departure floor-destination floor pair selected by the user on the basis of a touch detected with the touch-sensitive display, and to send a destination call to the control system 11 of the elevator system 10, which destination call identifies the departure floor and the destination floor that are according to the departure floor-destination floor pair selected by the user. In this way a user can with his/her touch select a pair, which functions as a speed-select. In this way the selection of both the departure floor and the destination floor from a plurality of floors can be performed with a low number of touches, e.g. with a single touch. In this case it is very quick to make a selection. The information of each aforementioned departure floor-destination floor pair (i.e. the departure floor and destination floor identified by it) is preferably recorded in the memory of the destination call-giving device 1. The destination call-giving device 1 is preferably one according to the embodiment presented in FIGS. 2 and 3.

Figure 2:
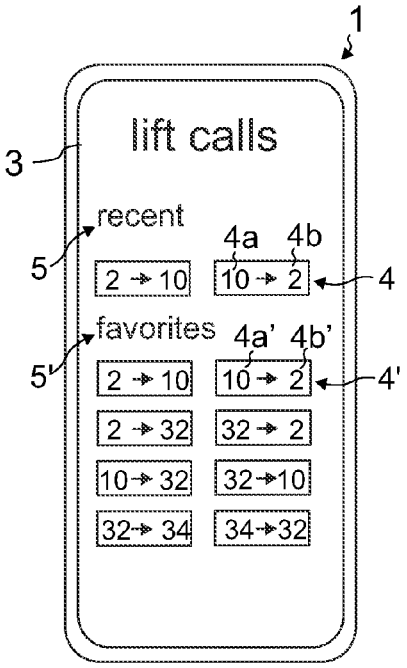
FIG. 2 presents an embodiment of a call-giving device according to the invention.
Figure 3:
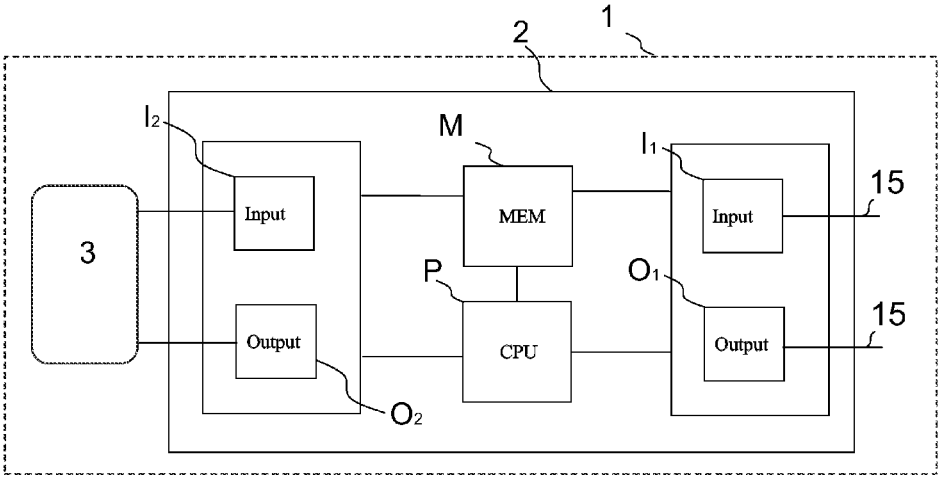
FIG. 3 presents one preferred structure of the call-giving device.

FIGS. 2 and 3 present a destination call-giving device 1 according to one embodiment for giving destination calls in an elevator system 10, which destination call-giving device 1 comprises means 2,3 available to a user for selecting a departure floor and a destination floor, and an output ($O_1$) for communicating the selected departure floor and destination floor to the control system 11 of the elevator system 10, which means 2,3 for selecting a departure floor comprise a touch-sensitive display 3 forming a user interface for presenting to the user information related to the selection of a departure floor and a destination floor and for receiving the input of the user. The means 2,3 for selecting a departure floor and a destination floor from a plurality of floors comprise a processing unit 2, which is arranged to present one or more predetermined departure floor-destination floor pairs 4,4' on the touch-sensitive display 3, in which each pair identifies for the user one predetermined departure floor and one predetermined destination floor, and to determine the departure floor-destination floor pair selected by the user on the basis of a touch detected with the touch-sensitive display 3, and to send a destination call signal to the control system 11 of the elevator system 10, which signal contains information, which identifies the departure floor and the destination floor that are according to the selection of the user. A destination call-giving device 1 is preferably, but not necessarily, arranged to present on a touch-sensitive display 3 to the user a confirmation of the sending of a call. In this way the user can receive for his/her information a confirmation of the sending of the call.

The destination call-giving device is preferably arranged to receive a response signal to the destination call signal sent to it from the control system 11 of the elevator system 10, which response signal contains information identifying the elevator car C, and the information identifying the elevator car C is arranged to be presented to the user on the touch-sensitive display 3. In this way the elevator car C allocated to the user by the elevator control can be notified to the user.

Each pair 4,4' is arranged to be presented on the touch-sensitive display 3 by presenting the departure floor 4*a*,4*a*' and the destination floor 4*b*,4*b*' identified by the pair in the proximity of each other. In the embodiment presented in FIG. 2, a pair is arranged to be presented on the touch-sensitive display 3 by presenting the departure floor 4*a*,4*a*' and the destination floor 4*b*,4*b*' identified by the pair beside each other, in this case side-by-side. Between the departure floor and the destination floor identified by each aforementioned pair 4,4' can be an arrow pointing to the destination floor, as is presented in FIG. 2.

The aforementioned departure floor-destination floor pairs 4,4' can comprise one or more departure floor-destination floor pairs 4, which identify the departure floor 4*a* and the destination floor 4*b* predetermined by the destination call-giving device 1. In this way a user can select the pair 4*b* defined by the destination call-giving device 1, in which case he/she does not need to himself/herself determine the floors identified by the pairs. The destination call-giving device 1 can in this case determine a pair/pairs 4 according to a certain logic. Preferably, a departure floor 4*a* and a destination floor 4*b* are arranged to be identified from the aforementioned one or more departure floor-destination floor pairs 4, which departure floor and destination floor correspond to the departure floor and the destination floor identified by a destination call signal sent earlier with the call-giving device 1 to the control system 11 of the elevator system 10. In this way the destination call-giving device 1 can offer a speed-select, the selecting of which repeats a destination call given earlier. In this case a user can quickly repeat a destination call given earlier. The pairs 4' determined by the destination call-giving device 1 can in this case be identified to belong to the recent calls category. For this purpose an indicator 5, referring to the pairs 4 in question, indicating the aforementioned category can be presented on the touch-sensitive display 3. For enabling the utilization of recent calls it is advantageous that the destination call-giving device 1, more particularly the means 2,3 of it for selecting a departure floor and a destination floor, is arranged to collect historical data about the departure floors and destination floors identified by destination call signals sent to the control system 11 of the elevator system 10 with the call-giving device 1. Preferably the destination call-giving device 1 can add new pairs to be presented. For enabling this it is advantageous that the destination call-giving device 1, more particularly the means 2,3 of it for selecting a departure floor and a destination floor, is arranged to form a new departure floor-destination floor pair 4 by setting the departure floor and the destination floor that are identified by the departure floor-destination floor pair to be formed to correspond to the departure floor and the destination floor identified by a destination call signal sent earlier with the call-giving device 1 to the control system 11 of the elevator system 10. The new departure floor-destination floor pair to be formed is preferably arranged to be recorded in the memory M of the destination call-giving device, which memory is most preferably long-lasting memory in such a way that the information of the new pair does not disappear in connection with extinguishing the destination call-giving device.

The aforementioned departure floor-destination floor pairs 4,4' can, in addition to or alternatively, comprise one or more departure floor-destination floor pairs 4', which identify a departure floor 4*a*' and a destination floor 4*b*' that are entered beforehand by the user and are recorded in the memory M. In this way a user can select a pair defined earlier some time by himself/herself, in which case it is quick to present to him/her an elevator call between floors important to him/her. The pairs 4' determined by the user can in this case be identified to belong to the category of calls entered by the user himself/herself, or favorites. For this purpose an indicator 5', referring to the pairs 4' in question, indicating the aforementioned category can be presented on the display. Preferably the destination call-giving device 1 can add new pairs 4' determined by a user to be presented. For enabling this it is advantageous that the destination call-giving device 1, more particularly the means 2,3 of it for selecting a departure floor and a destination floor, is arranged to form the new departure floor-destination floor pair by receiving a departure floor 4*a*' and a destination floor 4*b*' entered separately by the user for identifying the new departure floor-destination floor pair 4'.

A touch-sensitive area on the touch-sensitive display 3, e.g. a touch-sensitive pushbutton presented on the touch-sensitive display 3, as is presented in FIG. 2 (in FIG. 2 the triangular-shaped area at the point of each pair 4,4'), can be associated with each aforementioned departure floor-destination floor pair 4,4' to be presented on the touch-sensitive display 1, and the departure floor-destination floor pair selected by the user is determined on the basis of the point of the touch of the user. Preferably, the means 2,3 for selecting a departure floor and a destination floor are arranged to determine a departure floor-destination floor pair for selection by the user in response to a touch detected at the point of the touch-sensitive area associated with the pair in question. The touch-sensitive area associated with each pair is preferably at the point of the pair in question. The touch selecting the pair is preferably an individual point-form touch.

In the method according to the invention for giving a destination call to the control system 11 of an elevator system 10, one or more predetermined departure floor-destination floor pairs 4,4' are presented, in connection with call-giving, on the touch-sensitive display 3 of a call-giving device 1 having a touch-sensitive display, in which each pair 4,4' identifies for the user one predetermined departure floor 4*a*,4*a*' and one predetermined destination floor 4*b*,4*b*'. In the method the touch of a user is detected with the touch-sensitive display 3 and the departure floor-destination floor pair selected by the user is determined on the basis of the touch detected with the touch-sensitive display 3. After this a destination call signal is sent to the control system 11 of the elevator system 10, which signal contains information, which identifies the departure floor 4*a*,4*a*' and the destination floor 4*b*,4*b*' that are according to the departure floor-destination floor pair selected by the user. After sending a destination call preferably a confirmation about the sending of the destination call is presented to the user on the touch-sensitive display 3. After sending a destination call preferably a response signal to the destination call signal sent to it is received from the control system 11 of the elevator system 10, which response signal contains information identifying the elevator car C, and the information identifying the elevator car C is presented to the user on the touch-sensitive display 3.

In the method preferably a departure floor 4*a* and a destination floor 4*b* are identified from the aforementioned one or more departure floor-destination floor pairs 4, which floors correspond to the departure floor and the destination floor identified by a destination call signal sent earlier with the call-giving device 1 to the control system 11 of the elevator system 10. Recent calls can be utilized in the method in such a way that in the method a new departure floor-destination floor pair 4 is formed, in which case the departure floor 4*a* and the destination floor 4*b* that are identified by the departure floor-destination floor pair 4 are set to correspond to the departure floor and the destination floor identified by a destination call signal sent earlier with the call-giving device 1 to the control system 11 of the elevator system 10. In this way the destination call-giving device 1 can offer a speed-select, the selecting of which repeats a destination call given earlier. In this case it is quick for the user to repeat a destination call given earlier. The new departure floor-destination floor pair to be formed is preferably recorded in the memory M of the destination call-giving device. Preferably in the method historical data is collected about the departure floors and destination floors identified by destination call signals sent to the control system 11 of the elevator system 10 with a call-giving device 1.

In this way e.g. historical data can be used for forming new departure floor-destination floor pairs 4. Preferably the pairs 4 determined by the destination call-giving device 1 are in this case identified to belong to the recent calls category. For this purpose an indicator 5, referring to the pairs 4 in question, indicating the aforementioned category is preferably presented on the touch-sensitive display 3.

Preferably in the method a departure floor 4*a*' and a destination floor 4*b*' that are predetermined (input) by the user himself/herself are identified from the aforementioned one or more departure floor-destination floor pairs. It is advantageous for enabling determination by the user that in the method a phase is performed wherein a new departure floor-destination floor pair 4' is formed, in which case the user inputs separately a departure floor 4*a*' and a destination floor 4*b*' for identifying the new departure floor-destination floor pair 4'. For this purpose an input field (not presented) for numbers that is known in the art can be arranged in the user interface. Since this type of input made by a user does not need to be done more than once, it can be arranged with any method whatsoever known to produce and input a figure into a user interface. For accessing this function there can be on the touch-sensitive display a pushbutton (not presented), which opens for the user a field, in which the user can input his/her favorite floors 4*a*', 4*b*'. The new departure floor-destination floor pair to be formed is preferably recorded in the memory M of the destination call-giving device, which is most preferably long-lasting memory in such a way that the information of the new pair does not disappear in connection with extinguishing the destination call-giving device.

Preferably in the method a touch-sensitive area, preferably a touch-sensitive pushbutton, on the touch-sensitive display 3 is associated with each aforementioned departure floor-destination floor pair 4,4' to be presented on the touch-sensitive display 3 and the departure floor-destination floor pair selected by the user is determined on the basis of the point of the touch of the user. Preferably a departure floor-destination floor pair for selection by the user is determined in response to a touch detected at the point of the touch-sensitive area associated with the pair in question. That departure floor-destination floor pair 4,4' in which a touch is detected at the point of the associated touch-sensitive area is therefore determined as the departure floor-destination floor pair 4,4' selected by the user. For example, each rectangle marked with the reference number 4,4' can bound an area inside it that forms the touch-sensitive point associated with the pair in question. The aforementioned touch can be an individual point-form touch, in which case a destination call can be given with a very few touches. Preferably each pair 4,4' is presented on the touch-sensitive display 3 by presenting the departure floor 4*a* and the destination floor 4*b* identified by the pair in the proximity of each other, preferably beside each other. Between the departure floor 4*a*,4*a*' and the destination floor 4*b*,4*b*' identified by each aforementioned pair preferably an arrow pointing to the destination floor 4*b*,4*b*' is presented.

The computer program product according to the invention comprises program commands, which bring a computer 1 provided with a touch-sensitive display 3 and an output $O_1$ to perform a method according to what is described above, when they are run in the aforementioned computer 1, which is connected as a part of the elevator system and is arranged to communicate via the output $O_1$ with the control system 11 of the elevator system 10. The aforementioned computer provided with a touch-sensitive display 3,3' and an output $O_1$ can be e.g. in the form of a mobile phone. A computer program product can be e.g. a computer program that can be downloaded into a computer. The computer program can be a so-called application. The computer program product is preferably a computer program, which is arranged to be executed under the subordination of an operating system. The operating system can be e.g. iOS, Windows, Android or Symbian. More particularly, the program commands bring the computer to perform a method, in which one or more predetermined departure floor-destination floor pairs are presented on the touch-sensitive display 3 of a call-giving device 1 having a touch-sensitive display, in which each pair identifies for the user one predetermined departure floor and one predetermined destination floor, and the departure floor-destination floor pair selected by the user is determined on the basis of a touch detected with the touch-sensitive display 3, and a destination call signal is sent to the control system 11 of the elevator system 10, which signal identifies the departure floor and the destination floor that are according to the selection of the user.

The computer program can be stored in some type of conveying means, which can be any entity or device whatsoever that is able to store a program. Such conveying means comprise e.g. a recording means, a computer memory, a read-only memory, an electrical carrier wave, a telecommunications signal, and a software distribution package. A computer program product can be e.g. in source code format, in object code format or in some intermediate format.

FIG. 3 presents by way of reference a preferred structure for a destination call-giving device 1. The means comprised in the destination call-giving device 1 and available to a user for selecting a destination floor comprise a processing unit 2 for processing a touch signal received from the touch-sensitive display 3 and for executing program commands. The processing unit 2 comprises at least one processor P, which can be brought into telecommunications contact with a memory M, which is preferably also comprised in the processing unit 2. Alternatively the memory is separate to the processing unit 2. The memory M stores at least program commands and preferably also information related to the pairs 4,4'. The processing unit 2 is arranged to execute program commands stored in the memory M, which commands can be in the format of the software product mentioned earlier. For processing the touch signal and for executing program commands the processing unit 2 comprises, in addition to a processor P and a memory, connected to the processor an input $I_1$ from the control system of the elevator system, and an input 12 from the touch-sensitive display, and an output $O_1$ to the control system of the elevator system, and an output $O_2$ to the touch-sensitive display. Each of the aforementioned inputs and outputs is preferably able to transmit an electrical signal. Some of these signals can be wireless. For example, the aforementioned output $O_1$ to the control system of the elevator system can comprise a transmitter, such as e.g. an antenna, for transmitting a wireless signal to the control system 11 of the elevator system 10. This is advantageous e.g. when the destination call-giving device is portable. Correspondingly the input $I_1$ from the control system of the elevator system can comprise a receiver, such as e.g. an antenna, for receiving a wireless signal. The input $I_1$ and the output $O_1$ can use a shared antenna.

As has been stated above, the invention is suited for utilization in connection with a portable destination call-giving device. However, the invention is also suited for use in connection with other types of destination call-giving devices, e.g. in connection with destination call-giving devices installed in apartments or in other spaces.

The information identifying an elevator car to be presented on the touch-sensitive display can be any information whatsoever that enables identification of the allocated elevator. This information can be e.g. identification data of an elevator. An elevator car having an identifier B can in this case be identified e.g. with the text "Elevator B".

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. A method for giving a destination call to a control system of an elevator system, the method comprising the steps of:

presenting one or more departure floor-destination floor pairs on a touch-sensitive display of a destination call-giving device having the touch-sensitive display, wherein each pair identifies for the user one predetermined departure floor and one predetermined destination floor, determining a departure floor-destination floor pair selected by the user on the basis of a touch detected with the touch-sensitive display, sending a destination call signal to the control system of the elevator system, wherein the destination call signal identifies the departure floor and the destination floor of the departure floor-destination floor pair selected by the user.

2. The method according to claim 1, wherein information about said one or more departure floor-destination floor pairs is recorded in a memory of the destination call-giving device, wherein the memory is long-lasting in such a way that the information does not disappear in connection with extinguishing the destination call-giving device.

3. The method according to claim 1, further comprising the step of displaying a plurality of types of departure floor-destination floor pairs, wherein the departure floor-destination floor pair is selected from the plurality of types of departure floor-destination floor pairs by the user and is determined on the basis of the touch detected with the touch-sensitive display.

4. The method according to claim 1, further comprising the step of receiving a response signal to the destination call signal from the control system of the elevator system, wherein the response signal contains information identifying the elevator car, and the information identifying the elevator car is presented to the user on the touch-sensitive display.

5. The method according to claim 1, further comprising the step of identifying a departure floor and a destination floor from the one or more departure floor-destination floor pairs, wherein the departure floor and the destination floor correspond to the departure floor and the destination floor identified by the destination call signal sent earlier with the destination call-giving device to the control system of the elevator system.

6. The method according to claim 1, further comprising the step of forming a new departure floor-destination floor pair, wherein the departure floor and the destination floor that are identified by the departure floor-destination floor pair to be formed are set to correspond to the departure floor and the destination floor identified by a destination call signal sent earlier with the destination call-giving device to the control system of the elevator system.

7. The method according to claim 1, wherein a departure floor input earlier by the user and a destination floor input earlier by the user are identified for the user from the one or more departure floor-destination floor pairs.

8. The method according to claim 1, further comprising the step of forming a new departure floor-destination floor pair is formed, wherein the user inputs a departure floor and a destination floor for identifying the new departure floor-destination floor pair, and the new departure floor-destination floor pair is recorded in a memory of the destination call-giving device.

9. The method according to claim 1, wherein a touch-sensitive area on the touch-sensitive display is associated with each of the one or more departure floor-destination floor pairs presented on the touch-sensitive display, and the departure floor-destination floor pair selected by the user is determined on the basis of a point of the touch of the user.

10. A computer program product comprising a non-transitory computer-readable storage medium having computer-executable program commands for, when executed on a computer, instructing the computer to perform a method according to claim 1, wherein the computer includes a touch-sensitive display and an output for communicating with a control system of an elevator system.

11. A destination call-giving device for giving destination calls in an elevator system, the elevator system comprising a control system, the destination call-giving device comprising:

an input device provided to a user for selecting a departure floor and a destination floor, and an output for communicating the selected departure floor and destination floor to the control system of the elevator system, wherein the input device comprises a touch-sensitive display for presenting to the user information related to the selection of a departure floor and a destination floor and for receiving input of the user, and wherein the input device is configured to present one or more departure floor-destination floor pairs on the touch-sensitive display, in which each pair identifies for the user one predetermined departure floor and one predetermined destination floor, and to determine the departure floor-destination floor pair selected by the user on the basis of a touch detected with the touch-sensitive display, and to send a destination call signal to the control system of the elevator system, the destination call signal identifying the departure floor and the destination floor that are according to the selection of the user.

12. The destination call-giving device according to claim 11, further comprising a memory, wherein the information of the one or more departure floor-destination floor pairs is recorded in the memory, and the memory is long-lasting in such a way that the information in question does not disappear in connection with extinguishing the destination call-giving device.

13. The destination call-giving device according to claim 11, wherein the input device is configured to send to the control system of the elevator system a destination call automatically after detecting a selection.

14. An elevator system, comprising:

one or more elevator cars;

a control system; and a destination call-giving device according to claim 11, wherein the control system is configured to control the one or more elevator cars on the basis of destination calls of the destination call-giving device communicating with the control system.

15. The elevator system according to claim 14, wherein the control system is arranged to allocate an elevator car in response to a destination call received from the destination call-giving device, and to communicate the allocated elevator car to the destination call-giving device, and the destination call-giving device is arranged to identify for the user the allocated elevator car with the touch-sensitive display.

16. The method according to claim 2, further comprising the step of displaying a plurality of types of departure floor-destination floor pairs, wherein the departure floor-destination floor pair is selected from the plurality of types of departure floor-destination floor pairs by the user and is determined on the basis of the touch detected with the touch-sensitive display.

17. The method according to claim 2, further comprising the step of receiving a response signal to the destination call signal from the control system of the elevator system, wherein the response signal contains information identifying the elevator car, and the information identifying the elevator car is presented to the user on the touch-sensitive display.

18. The method according to claim 3, further comprising the step of receiving a response signal to the destination call signal from the control system of the elevator system, wherein the response signal contains information identifying the elevator car, and the information identifying the elevator car is presented to the user on the touch-sensitive display.

19. The method according to claim 2, further comprising the step of identifying a departure floor and a destination floor from the one or more departure floor-destination floor pairs, wherein the departure floor and the destination floor correspond to the departure floor and the destination floor identified by the destination call signal sent earlier with the destination call-giving device to the control system of the elevator system.

20. The method according to claim 3, further comprising the step of identifying a departure floor and a destination floor from the one or more departure floor-destination floor pairs, wherein the departure floor and the destination floor correspond to the departure floor and the destination floor identified by the destination call signal sent earlier with the destination call-giving device to the control system of the elevator system.

* * * * *